United States Patent [19]

Keutgen et al.

[11] Patent Number: 5,033,536

[45] Date of Patent: Jul. 23, 1991

[54] METHOD AND APPARATUS FOR A HORIZONTAL CONTINUOUS CASTING APPARATUS FOR METALS

[75] Inventors: Franz Keutgen, Lissendorf; Peter Voss-Spilker, Kempen; Achim Kubon, Neukirchen-Vluyn, all of Fed. Rep. of Germany

[73] Assignee: Mannesmann Aktiengesellschaft, Düsseldorf, Fed. Rep. of Germany

[21] Appl. No.: 405,959

[22] Filed: Sep. 12, 1989

[30] Foreign Application Priority Data

Sep. 14, 1988 [DE] Fed. Rep. of Germany ..... 3831595

[51] Int. Cl.[5] ..... B22D 11/10

[52] U.S. Cl. ..... 164/490; 164/436; 164/440; 164/491

[58] Field of Search ..... 164/440, 490, 436, 491

[56] References Cited

U.S. PATENT DOCUMENTS

| | | | |
|---|---|---|---|
| 3,605,870 | 9/1971 | Krall | 164/440 |
| 3,752,218 | 8/1973 | Gamble et al. | 164/440 |
| 3,794,105 | 2/1974 | Voss | 164/436 |
| 4,491,169 | 1/1985 | Durand-Texte | 164/440 |
| 4,566,523 | 1/1986 | Vaubel | 164/491 |
| 4,640,335 | 2/1987 | Clark et al. | 164/440 |
| 4,699,201 | 10/1987 | Gladwin | 164/436 |
| 4,774,996 | 10/1988 | Ahrens et al. | 164/440 |

FOREIGN PATENT DOCUMENTS

| | | | |
|---|---|---|---|
| 268143 | 5/1988 | European Pat. Off. | 164/436 |
| 61-176446 | 8/1986 | Japan | 164/436 |
| 1096020 | 7/1984 | U.S.S.R. | 164/436 |

*Primary Examiner*—Kurt Rowan
*Assistant Examiner*—Rex E. Pelto
*Attorney, Agent, or Firm*—Cohen, Pontani & Lieberman

[57] ABSTRACT

A horizontal continuous casting apparatus for metals, particularly steel, having a supply container in the metal outlet opening of which there is arranged a nozzle brick against which a separation ring rests in sealing manner, and having a continuous casting mold which is connected to the supply container and rests with the edge sides of its side walls in sealing manner against the separation ring. A reliable changing of the passage cross-section of the mold before, during and after the casting is possible in a structurally simple manner. The passage cross-section (A) of the continuous casting mold (30) is adjusted and displacement elements (40) are provided by means of which the position of the side walls (31 to 34) of the continuous casting mold (30) is adjusted. At least one side wall (31 to 34) is moveable parallel and transverse to the center line I of the outlet opening 11.

20 Claims, 7 Drawing Sheets

METHOD AND APPARATUS FOR A HORIZONTAL CONTINUOUS CASTING APPARATUS FOR METALS

BACKGROUND AND SUMMARY OF THE INVENTION

The present invention relates to an adjustable continuous casting mold, and a method of adjusting a casting mold prior to, during and after casting in an effective manner. More particularly, the apparatus and method of the present invention relate to a continuous casting mold, the cross-sectional area of which can be adjusted by moving at least one of the side walls forming the mold.

Adjustable continuous casting molds for vertical casting machines are known. In these continuous casting machines, however, no sealing problems arise in the region between supply container and mold which are comparable to those of horizontal continuous casting machines for metals.

From West German Patent 26 58 242 there is known a horizontal continuous casting machine for metals which has a clamping device which is connected, on the one hand, to the mold and, on the other hand, directly to a liquid-metal conduit, a device for regulating the contact pressure of the liquid-metal conduit against the mold being provided so as to assure a tight, metal-impervious joint. This patent does not teach changing the cross-section of the mold. With respect to sealing, the device known from this patent has the disadvantage that the mount which fixes the rigid mold at its one end rests at its other end on the liquid-metal conduit. In order to absorb the forces between the liquid-metal conduit and the supply container, the rigid mold is connected via an expensive arrangement, namely foundation, base plate, bearing pedestal and displacement apparatus. The multitude of elements and the great number of possible external influences do not permit the short paths and precise adjustments of force in the region of the sealing surface which are required for an adjustable mold.

Leaking liquid metal, however, could lead to the interruption of the casting. The discontinuation of the casting has the result, in the case of a rigid mold, that solidified residual pieces remain in the mold and can only be removed with great difficulty.

It is the object of the invention to avoid the above-mentioned disadvantages and to provide a method and an apparatus for an adjustable continuous casting mold which enables a reliable changing of the passage cross-section of the mold in a structurally simple manner before, during and after the casting.

This object is obtained by providing a horizontal casting apparatus for metals, in particular steel, which comprises a liquid metal supply container having a metal outlet opening therein; a continuous casting mold adjacent the outlet of the supply container, the casting mold comprising side walls having side edges and forming a conduit having an adjustable cross-sectional area for the metal to flow therethrough; and elements for adjusting the position of at least one of the side walls parallel and transverse or perpendicular to the center axis or center line of the outlet opening thereby adjusting the cross-sectional area of the casting mold. For the sealing off of the separation area between separation ring and edge surface of the mold, adjustment elements are provided which detachably connect together the mold, forming a force-locked connection facing in the direction of the center line towards the supply container. From the contact surfaces of the side walls arranged parallel to the center line an intimate or force-locked connection is provided. Depending on the number of detachable sealing surfaces, the passage cross-section can be varied in height and width or only in height or only in width.

The change in position of the displaceable side walls is so controlled with respect to time that the most strongly stressed sealing surface in the region of the separation ring is relaxed first. In order to facilitate the starting of the displacement, the displacement force is applied in pulsating manner.

For the adjustment of the mold elements are selected which provide a high degree of reliability after the adjustment process. Depending on the requirements, adjustment apparatus with energy-storing elements (for instance springs) or self-locking elements (for instance spindles) can be used.

With the horizontal continuous casting apparatus of the present invention, only a small supply of molds is required, since the adjustable mold covers entire ranges of cross-sections. Before the casting, the variation in "thickness" or "width" can be selected by a corresponding mold.

The casting of small lots or of several casting cross-sections from a large melt is rendered possible without interrupting the casting or changing of the molds.

The adjustable mold of the invention makes it possible to adapt the mold not only to a different quality of casting but also to a different speed of casting. This adaptation is possible during the casting by adjusting the passage cross-section with simultaneous adjustment of the conicity even during the casting. This is particularly important for the beginning and ending of the casting.

The method is particularly suitable for thin casting products (thickness less than 50 mm) since the start of the process is less sensitive. This is possible since, to be on the safe side, upon the starting up a larger initial thickness can be selected which can then be corrected during casting. Only a single starting head is required in this connection for different casting cross-sections. In addition, this process is made more reliable as a whole by the longer time of filling of the mold.

The already greater reliability of the tightness resulting from the use of the adjustment elements disclosed can also be increased by shaping the sealing surfaces. Excellent sealing results are obtained when the edge surface of the side walls is developed as elements which are compressible in the region of the sealing surface and have a high restoring force, such as is true of the lip-shaped development of the front surfaces. Good results are also obtained by the combination of a straight edge surface and a seal which is operatively connected therewith, for instance a squeezable metallic seal.

As a further advantageous seal there is provided a conical sealing surface of the separation ring in the region of the displaceable side wall. In this embodiment, after the relaxation of the side wall in the direction of the center line by the pressure of the liquid casting material, the side wall is pressed, as a function of the pre-established relaxation, against the "higher" located conical part of the separation ring.

Another advantage of the horizontal continuous casting mold of the present invention becomes evident when the casting process is not properly terminated. Handling and repair after a so-called mold plug or a casting frozen in the mold are considerably facilitated by the possibility of displacing the side surfaces, in contradistinction to other non-adjustable horizontal continuous casting molds.

BRIEF DESCRIPTION OF THE DRAWINGS

Embodiments of the invention are shown in the drawings and will be described below. In the drawings.

DETAILED DESCRIPTION OF THE INVENTION

Figure 1:
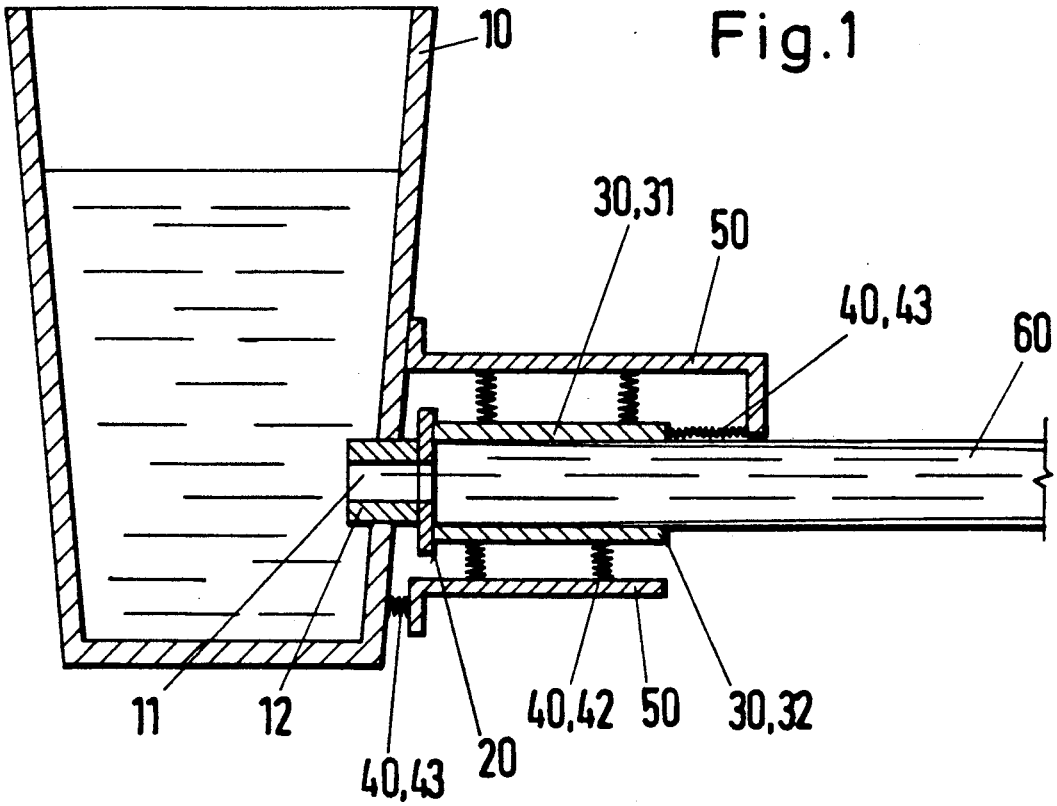
FIG. 1 is a section through a horizontal continuous casting installation.

FIG. 1 shows the supply container 10 with the outlet opening 11 in which the nozzle brick 12 is arranged. The separation ring 20 is arranged on the nozzle brick 12 in the direction of outlet, against which the continuous casting mold 30 (here shown with the broad side 31 on top and the broad side 32 on the bottom) rests. The continuous casting mold 30 forms the casting 60.

The base plate 50 is detachably attached to the supply container 10. Between the base plate 50 and the continuous casting mold 30, adjustment elements 40–43 are arranged (perpendicular to the center line, element 42 and in the same direction as the center line, element 43).

Figure 2A:
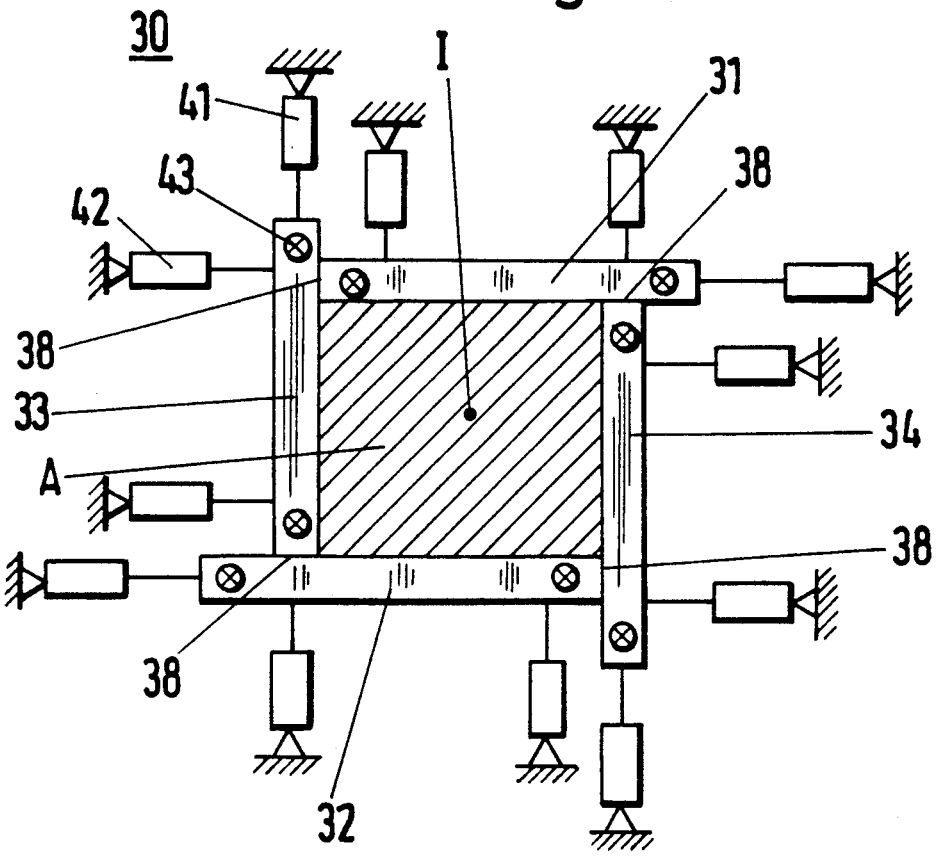
FIG. 2 is a mold having one or four moveable side walls.
Figure 2B:
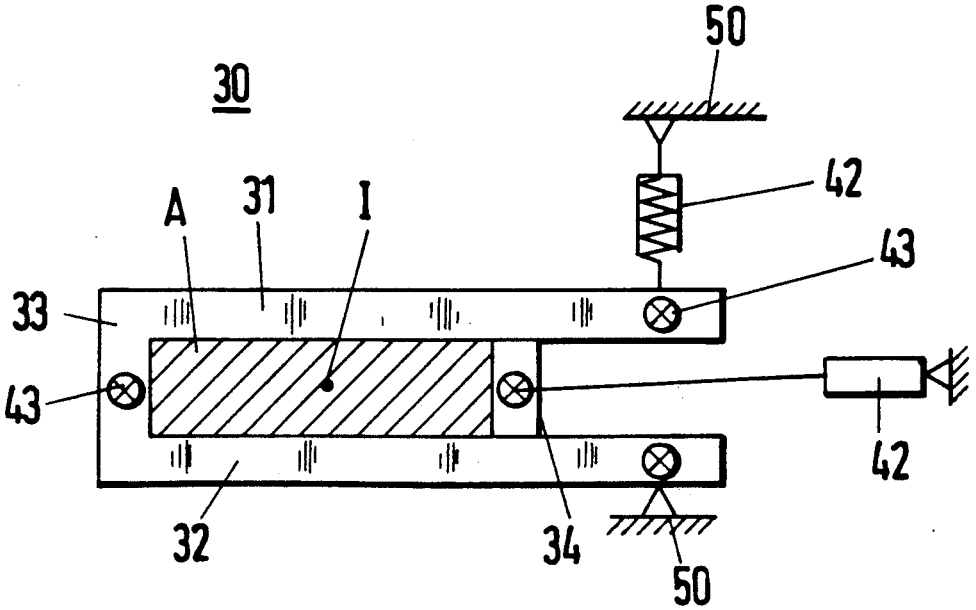

FIG. 2 shows in its upper part a mold with four adjustable side walls 31 to 34. The side walls 31 to 34 form the passage cross-section A which is discharged in the direction of the center line I. Each side wall 31 to 34 rests with its edge side 38 against an adjacent wall and is held in this position by an adjustment element 41. The adjustment elements 42 and 43 are provided for displacement of the side walls 31 to 34 perpendicular to the center line and in the direction of the center line.

The lower part of FIG. 2 shows a continuous casting mold 30 in which three side walls 31, 32, 33 are intimately connected together to form a U-shaped structural part and wherein the side wall 34 is adjustable. For the adjustment of the passage cross-section A, the narrow wall 34 is moved by the adjustment element 42. To facilitate this movement the U-shaped structural part is moved on one leg (wide wall 31) by the adjustment element 42 which rests on the base plate 50. The adjustment elements 43 serve to establish the force-locked connection of the side walls 31 to 34 to the separation ring not shown).

Figure 3A:
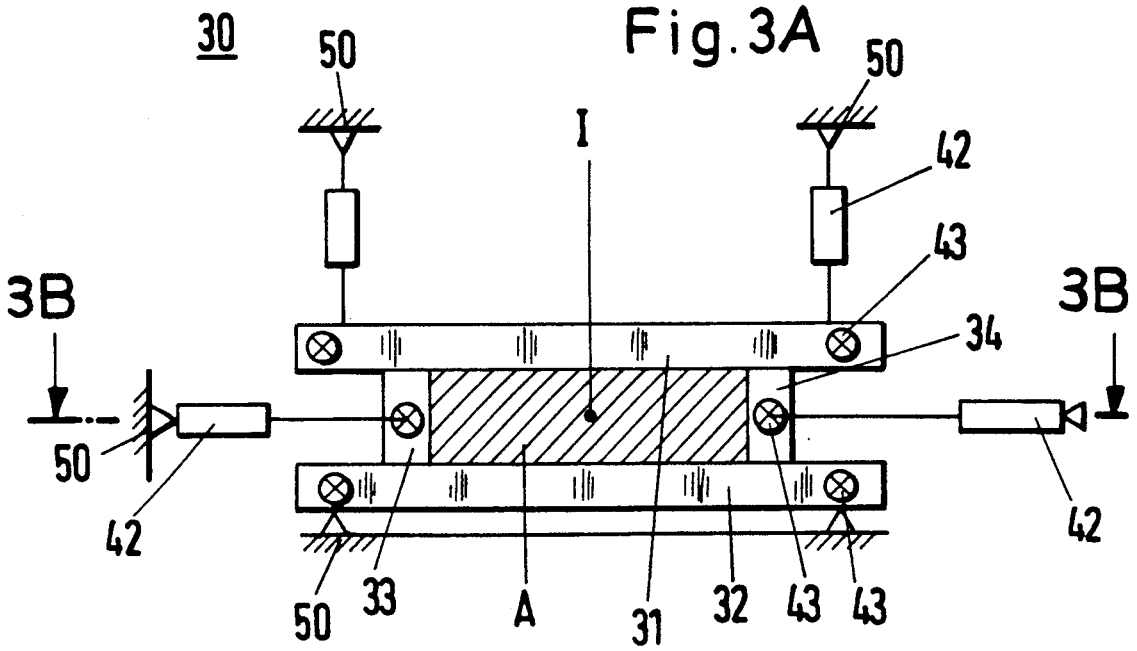
FIG. 3 is a transverse and longitudinal view of a mold having two adjustable side walls.
Figure 3B:
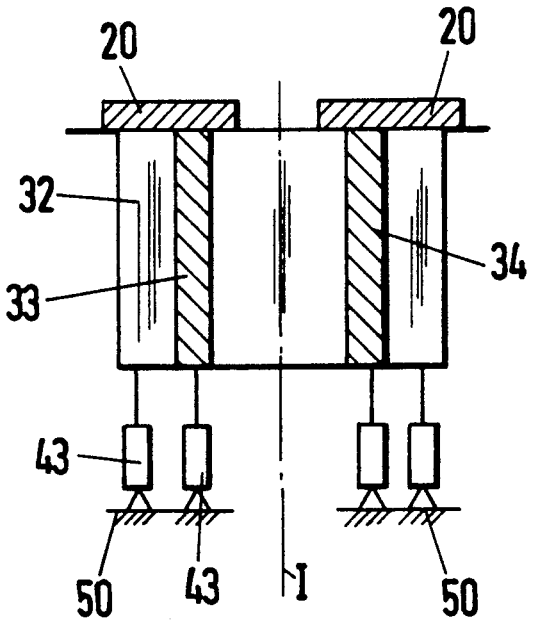

FIG. 3 shows a continuous casting mold 30, having two adjustable narrow walls 33 and 34. The wide wall 32 is fixed in position by the base plate 50. The wide wall 31 is held in force-locked manner against the side walls 33 and 34 by the adjustment elements 42. The narrow walls 33 and 34 are changed in their position by the adjustment elements 42, which rest on the base plate 50. All walls of the mold are pressed against the separation ring (not shown) by adjustment elements 43.

The lower part of FIG. 3 shows the section B—B through the continuous casting mold. The wide wall 32 and the narrow walls 33 and 34 are pressed against the separation ring 20 in the direction of the center line I by the adjustment elements 43 which rest on the base plate 50.

Figure 4A:
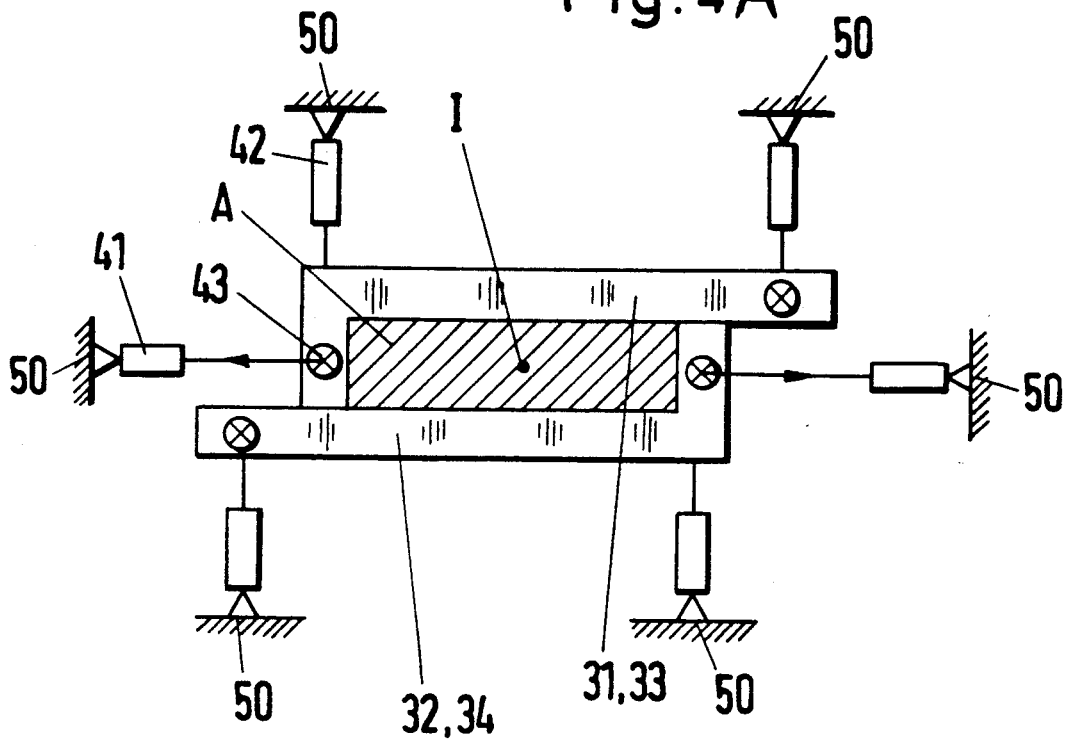
FIG. 4 is a mold with side walls arranged in L-shape.
Figure 4B:
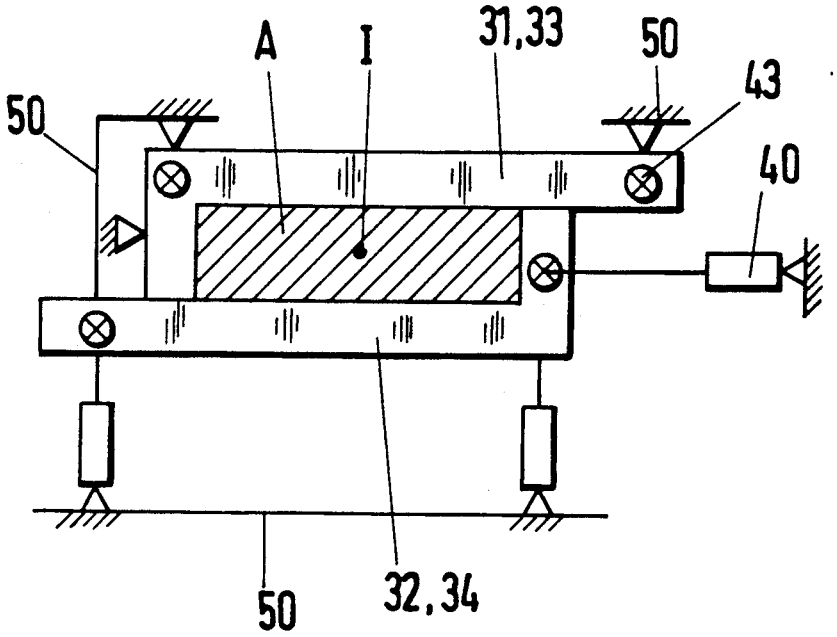

FIG. 4 shows a continuous casting mold 30 in which each two side walls, 31, 33 and 32, 34 respectively, are connected in L-shape. Both L-shaped structural parts 31, 33 and 33, 34 are displaceable with respect to each other and thus change the passage cross-section A. Adjustment elements 41, 42, 43 which rest on the base plate 50 ar provided for the adjustment and holding. The lower part of FIG. 4 shows a mold having L-shaped structural parts, one L-shaped part being fixed in position.

Figure 5A:
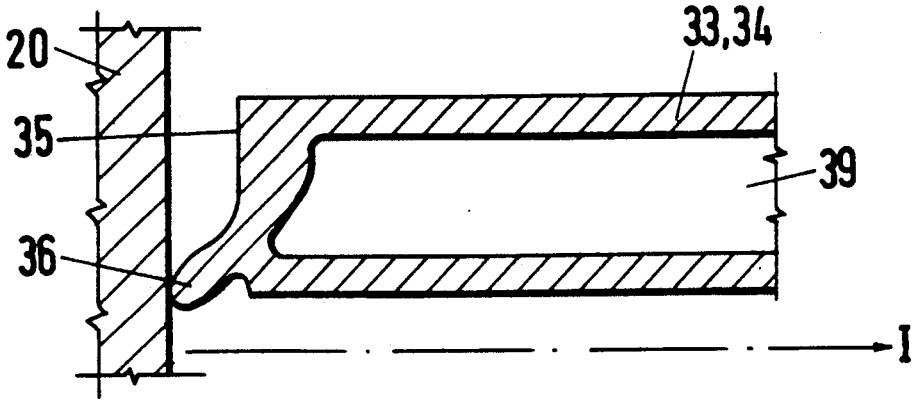
FIG. 5 is a detail of the edge side of a side wall.
Figure 5B:
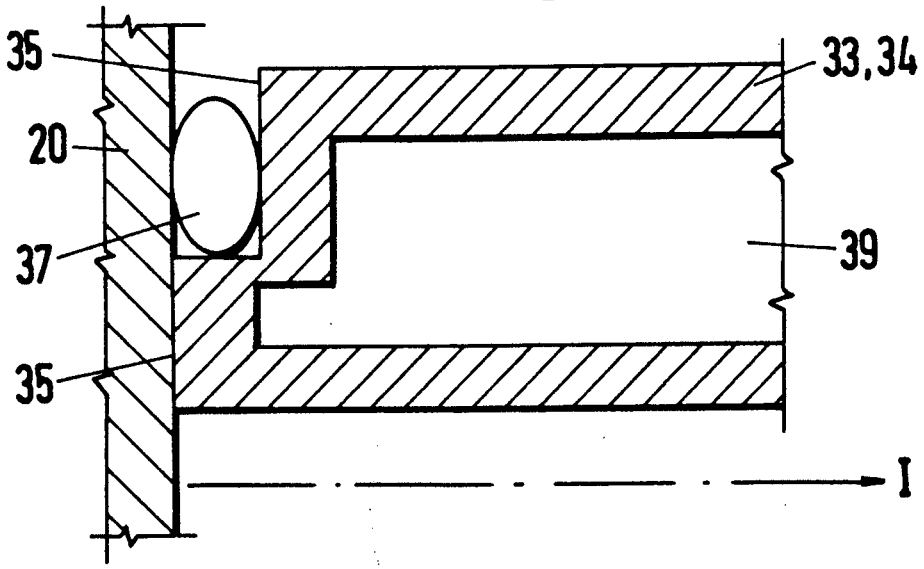

View "C" of FIG. 5 shows a detail of the section, FIG. 3 lower part. The section shows a part of a mold wall 33–34 with the water-conducting chamber 39. In the upper part of FIG. 5, the lip 36 is shown on the edge side 35 which rests against the separation ring 20. The lip 36 points in this case in the direction of the separation ring and at the same time in the direction of the center line I.

In the lower part of FIG. 5, a part of the edge side 35 which faces the center line I rests against the separation ring 20. The part of the edge side 35 facing away from the center line is spaced from the separation ring. A squeezable sealing element 37 is arranged in the space between separation ring 20 and edge side 35. The sealing element 37 assures better tightness of the sealing surface.

Figure 6A:
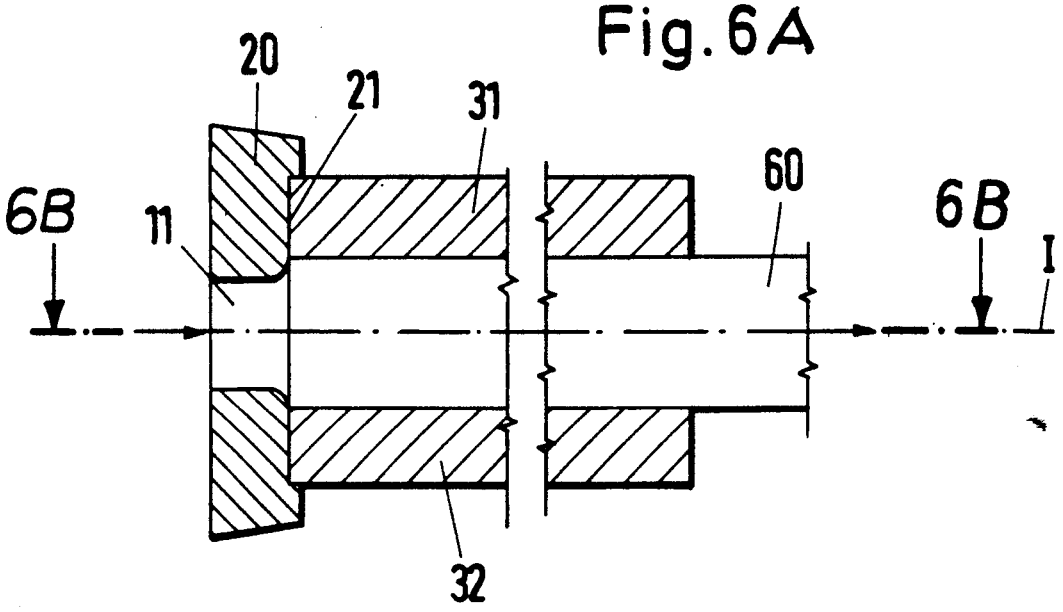
FIG. 6 shows an arrangement of the mold on a straight separation ring.
Figure 6B:
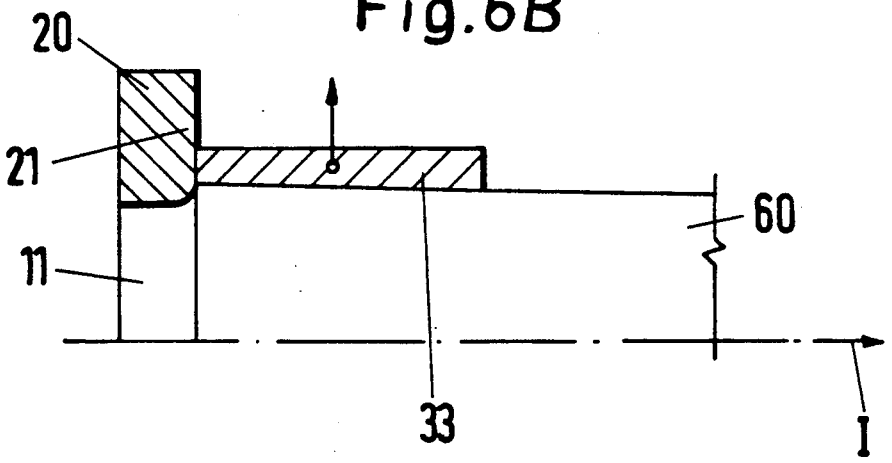
Figure 7A:
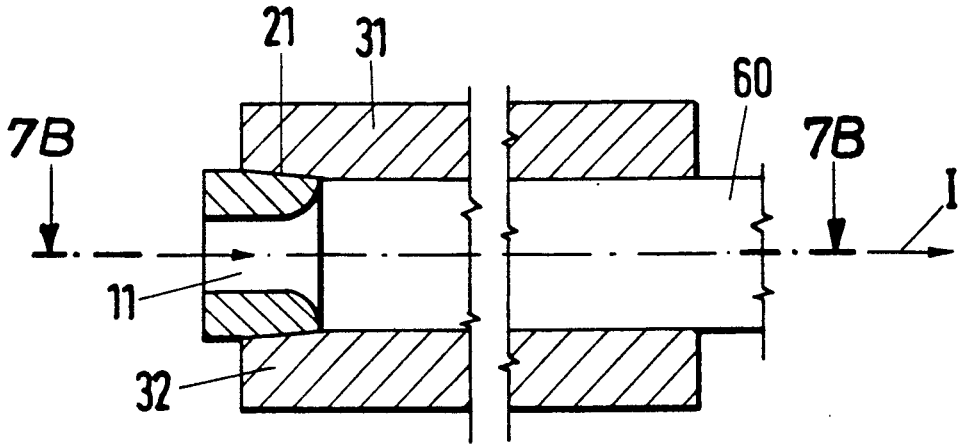
FIG. 7 shows the arrangement of the mold on a conical separation ring.
Figure 7B:
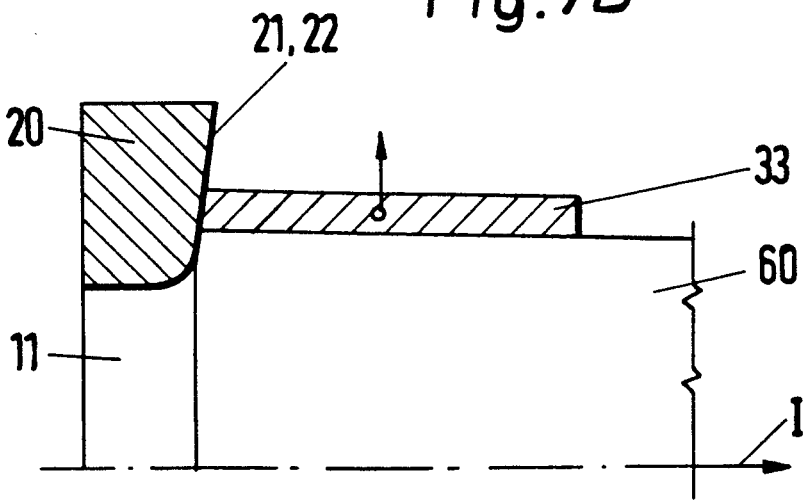

FIGS. 6 and 7 show in each case two sections through the separation ring 20 and the continuous casting mold 30, with the casting 60, namely the wide walls 31 and 32, in the upper part of the FIGURE and the narrow walls 33 in the lower part thereof. In FIG. 6, the side surface 21 of the separation ring 20 extends perpendicular to the outlet opening 11.

In FIG. 7 the wide wall rests against the outward-facing side surface of the separation ring 20 approximately parallel to the outlet opening 11. The narrow wall 33 has the conical side surface 22 as sealing surface. In this case the wall thickness of the separation ring 20 increases with increasing distance from the outlet opening 11.

We claim:

1. A horizontal casting apparatus for metals, in particular steel, comprising:

a liquid metal supply container (10) having a metal outlet opening (11) therein, said outlet opening having a center line (I);

a horizontal continuous casting mold (30) adjacent said outlet opening of said supply container, said casting mold comprising side walls (31–34) having first side edges (38) and forming a conduit having an adjustable cross-sectional area (A) for said metal to flow therethrough in a horizontal direction, at least one of said side walls being movable along said horizontal direction of flow and transverse to said center line of said outlet opening; means between said supply container and said casting mold for applying a sealing force therebetween; and one or more elements (40) for adjusting the position of said at least one of said side walls along said horizontal direction of flow for adjusting said sealing force and transverse to said center line for adjusting said cross-sectional area (A).

2. The apparatus according to claim 1, wherein said outlet opening comprises a nozzle brick and a separation ring in sealing relation with said nozzle brick.

3. The apparatus according to claim 1, additionally comprising a base plate (50); and wherein said element adjusting the position of said side wall is secured to said base plate.

4. The apparatus according to claim 3, wherein said base plate (50) is detachably fastened to said supply container (10).

5. The apparatus according to claim 3, wherein said side walls comprise at least a wide wall and a relatively narrower wall; and wherein said adjustment element (41, 43) attached to said wide wall (31, 32) comprises a spring (44).

6. The apparatus according to claim 3, wherein said side walls comprise at least a wide wall and a relatively narrower wall; and wherein said adjustment element attached to said narrower wall comprises an adjustment apparatus.

7. The apparatus according to claim 6, wherein said adjustment apparatus comprises a detachable spring unit.

8. The apparatus according to claim 7, wherein said spring unit comprises a hydraulic cylinder.

9. The apparatus according to claim 6, wherein said adjustment apparatus comprises an adjustment motor including screw or spindle.

10. The apparatus according to claim 1, wherein each side wall (31–34) comprises an inward surface arranged parallel to and facing said center line (I); said side edges (38) resting against said inward facing surfaces.

11. The apparatus according to claim 1, wherein said side walls comprise a first pair of wide walls (31, 32) and a second pair of relatively narrower walls (33, 34) abutting said first pair of walls.

12. The apparatus according to claim 11, wherein one of said wide walls and one of said narrower walls (31, 33; 32, 34) are integrally connected to form an L-shaped structure.

13. The apparatus according to claim 11, wherein said wide walls (31, 32) and one of said relatively narrower walls (33 or 34) forms an integral U-shaped structure therewith.

14. The apparatus according to claim 13, wherein said adjustment elements are connected at least with one arm of said U-shaped structure (31, 33, 32 or 31, 34, 32) and with one of said relatively narrower side walls (33, 34).

15. The apparatus according to claim 1, additionally comprising a separation ring (20) located within said outlet (11), and a central axis within said outlet said ring being arranged circumferentially about said axis of said outlet and in sealing relation therewith and having a surface (21) facing away from said supply container; and a second side edge (35) on said side walls linearly abutting said surface.

16. The apparatus according to claim 15, wherein said surface is conically shaped and slanted with respect to and toward said axis of said outlet.

17. The apparatus according to claim 15, additionally comprising a lip (36) at said second side edge (35) for forming said linear abutment.

18. The apparatus according to claim 15, additionally comprising a resilient sealing element (37) between said separation ring and said second side edge (35) for forming said linear abutment.

19. A method of adjusting the cross-sectional area of a mold of a horizontal continuous casting apparatus comprising a liquid metal supply container having a metal outlet opening therein, said outlet opening having a center line (I); said method comprising:

forming a horizontal continuous casting mold adjacent said supply container by arranging side walls in the direction parallel to said center line and circumferentially around said center line so as to form a conduit for said metal;

providing a seal having a defined sealing force between said supply container and said walls;

varying the cross-sectional area of said conduit by moving at least one of said side walls parallel and transverse to said center line; and relaxing said sealing force after the initiation of said moving step.

20. The method according to claim 19, wherein said moving step is performed in a pulsating fashion.

* * * * *